US007556384B2

(12) United States Patent
Chan

(10) Patent No.: US 7,556,384 B2
(45) Date of Patent: Jul. 7, 2009

(54) PRESS-UP TRI-FOLD DISPLAY DEVICE

(75) Inventor: Sik Leung Chan, Tsuen Wan (HK)

(73) Assignee: C.C. & L Company Limited, Tsuen Wan, N.T. Hong Kong (HK)

( * ) Notice: Subject to any disclaimer, the term of this patent is extended or adjusted under 35 U.S.C. 154(b) by 622 days.

(21) Appl. No.: 11/266,834

(22) Filed: Nov. 4, 2005

(65) Prior Publication Data

US 2006/0168864 A1 Aug. 3, 2006

Related U.S. Application Data

(60) Provisional application No. 60/642,130, filed on Jan. 7, 2005.

(51) Int. Cl.
*G03B 21/28* (2006.01)
*G03B 21/00* (2006.01)
*G02B 7/182* (2006.01)

(52) U.S. Cl. ..... 353/99; 353/122; 40/733; D6/310; D6/312; 359/871; 359/872

(58) Field of Classification Search ..... 353/99, 353/122; 40/733; D6/310, 312; 359/871, 359/872

See application file for complete search history.

(56) References Cited

U.S. PATENT DOCUMENTS 2,201,251 A * 5/1940 Van Patten ..... 362/141
3,444,685 A 5/1969 Juillerat
D304,712 S * 11/1989 Cheung ..... D12/191
D370,129 S * 5/1996 Freudenfeld ..... D6/301
5,887,373 A * 3/1999 Byers ..... 40/733
6,024,215 A 2/2000 Chan
6,178,085 B1 1/2001 Chan
6,206,281 B1 3/2001 Chan
6,238,022 B1 5/2001 Chan
6,249,431 B1 6/2001 Chan
6,363,639 B1 4/2002 Chan
6,443,615 B1 9/2002 Chan
6,508,396 B1 1/2003 Chan
6,637,139 B1 * 10/2003 Chan ..... 40/725
6,712,211 B1 3/2004 Chan
6,804,170 B1 10/2004 Chan
6,955,442 B1 10/2005 Chan
7,192,183 B2 3/2007 Chan
D543,707 S 6/2007 Chan

* cited by examiner

*Primary Examiner*—Diane I Lee
*Assistant Examiner*—Magda Cruz
(74) *Attorney, Agent, or Firm*—Daniel P. Burke & Associates, PLLC

(57) ABSTRACT

A trifold display device comprising panel opening mechanism(s) which open the device, in a damped motion, from a closed position wherein display surfaces are concealed from view to an open configuration wherein three display surfaces are exposed. The panel operating mechanisms exert forces on two panels, thereby urging the panels toward an open position. Upon actuation of a release latch, the opening mechanisms move a support panel around to the back of the mirror, thereby raising the device into a tilted position (if the device is resting on a surface). Preferably simultaneously, the two movable display panels are also moved to an open configuration wherein they are exposed.

37 Claims, 16 Drawing Sheets

PRESS-UP TRI-FOLD DISPLAY DEVICE

RELATED APPLICATION DATA

This application claims the benefit of U.S. provisional patent application Ser. No. 60/642,130 filed on Jan. 7, 2005 and U.S. design application Ser. No. 29/220,386, filed Dec. 29, 2004.

The present invention is directed to a display device, such as a mirror which can conveniently be carried in a pocket or purse, and which opens to provide three display, e.g., reflective, surfaces.

BACKGROUND OF THE INVENTION

Many people enjoy variations of otherwise common items, particularly where that variation is aesthetically pleasing and enhances the functionality of the common item. Therefore, it is desirable to provide otherwise known devices with enhancements which facilitate their functionality and provide a pleasing, overall appearance. The novelty of the variation is particularly important in the promotional goods industry wherein a company wishing to promote itself or a particular product will typically have its name or logo imprinted upon an item which can be given away as a prize or as part of a promotional effort.

Small mirrors, such as pocket mirrors and compact cases comprising mirrors, have been well known for many years. A conventional compact case comprises a two-part housing connected at one end with a hinge and having a clasp. A mirror is typically affixed to one internal side of the housing.

SUMMARY OF THE INVENTION

One preferred embodiment of the present invention comprises a trifold mirror comprising a movable support, three reflective surfaces two of which are on movable panels, and panel/support opening mechanisms which open the device from a first, closed position, wherein the reflective surfaces are concealed from view, to a second open configuration wherein three reflective surfaces are exposed for use. According to this preferred embodiment, the device is initially positioned in a closed configuration wherein the reflective surfaces are in a generally overlapping configuration. The panel/support operating mechanisms exert forces on two of the panels and the support, thereby urging the reflective panels and the support toward an open position. According to this preferred embodiment, a support is positioned in overlapping relation with the reflective panels when the device is in the closed position. Upon actuation of a release latch, the panel opening mechanisms move the support around to the back of the mirror, thereby raising the device into a tilted position (if the device is resting on a surface). Preferably simultaneously, the two movable reflective panels are also moved to an open configuration wherein the reflective surfaces are exposed. According to the presently most preferred embodiment of the present invention, the two movable reflective panels are disposed at an obtuse angle to a central reflective panel when the device is in the open configuration.

This preferred illustrated embodiment of the present invention offers an enhancement over some common mirrors by providing a support for a mirror and thereby eliminating a need for a user to hold the mirror with one hand while using the mirror. This embodiment also increases the reflective surface approximately trifold, relative to a similarly sized device in the closed position.

According to another embodiment of the present invention the movable display panels are arranged in a coplanar configuration when the display device is in a closed position. According to a still further embodiment of the present invention, the movable display panels and the movable support are arranged in a coplanar configuration when the display device is in a closed position.

While the illustrated embodiments of the present invention are shown with three mirror surfaces, alternative embodiments of the present invention replace one or more of the mirror surfaces with other display surfaces, for example, one or more of the display surfaces can serve as a picture frame.

Preferred embodiments of the present invention are portable devices which can be readily carried in a purse. Other embodiments are larger.

DETAILED DESCRIPTION

Figure 1:
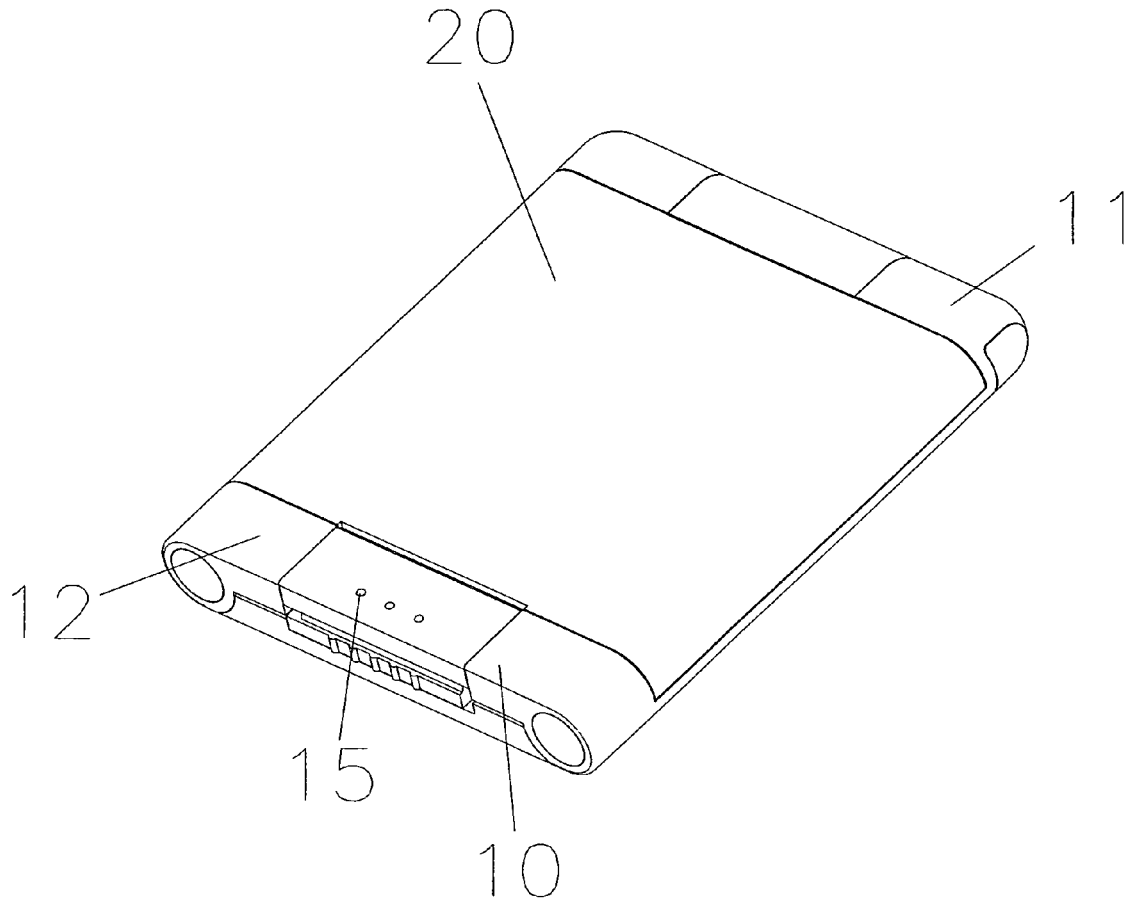
FIG. 1 is a perspective view of one embodiment of the present invention in a closed configuration.
Figure 2:
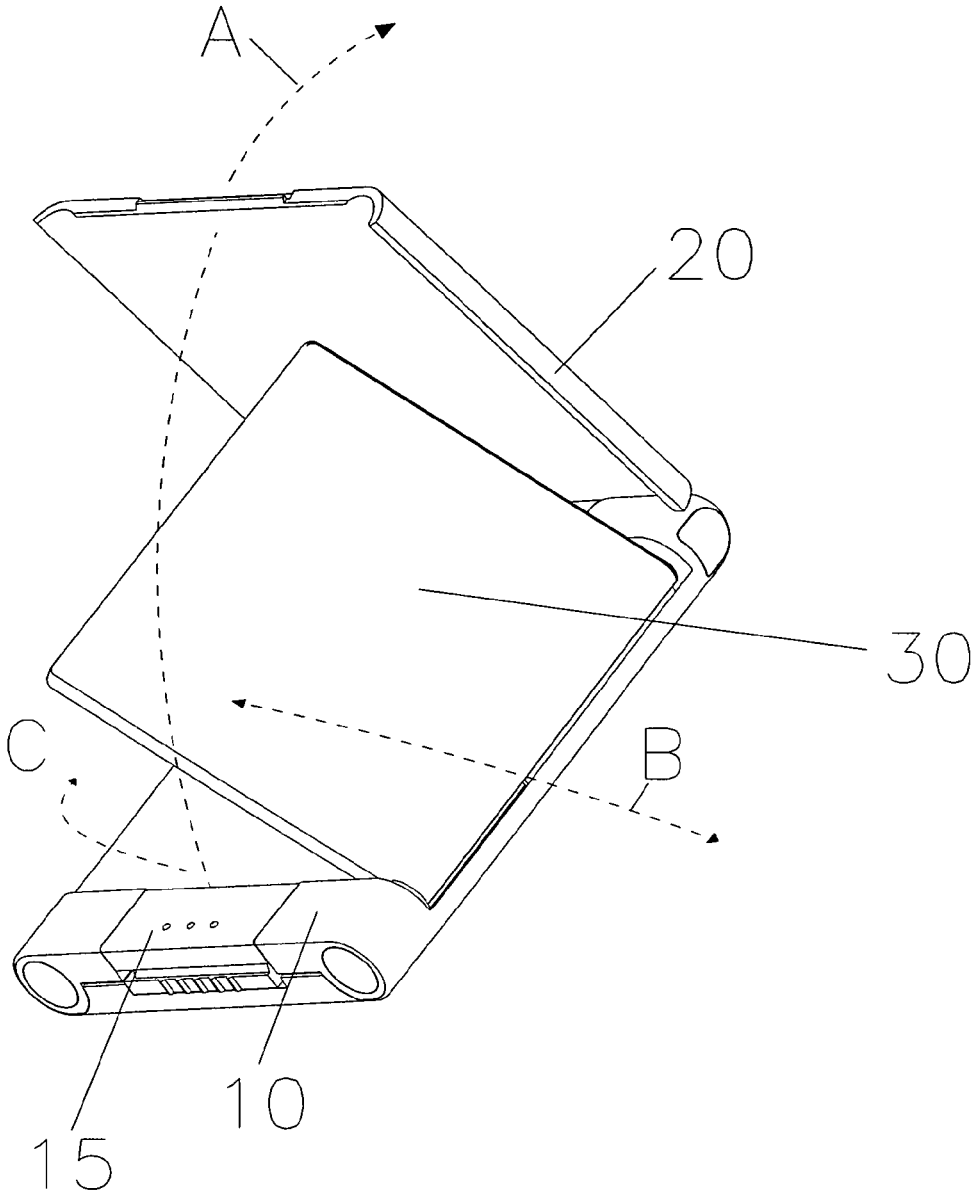
FIGS. 2, 3 and 4 generally illustrate intermediate positions of the movable support and movable reflective panels after actuation of the actuator button for the embodiment shown in FIG. 1.
Figure 11:
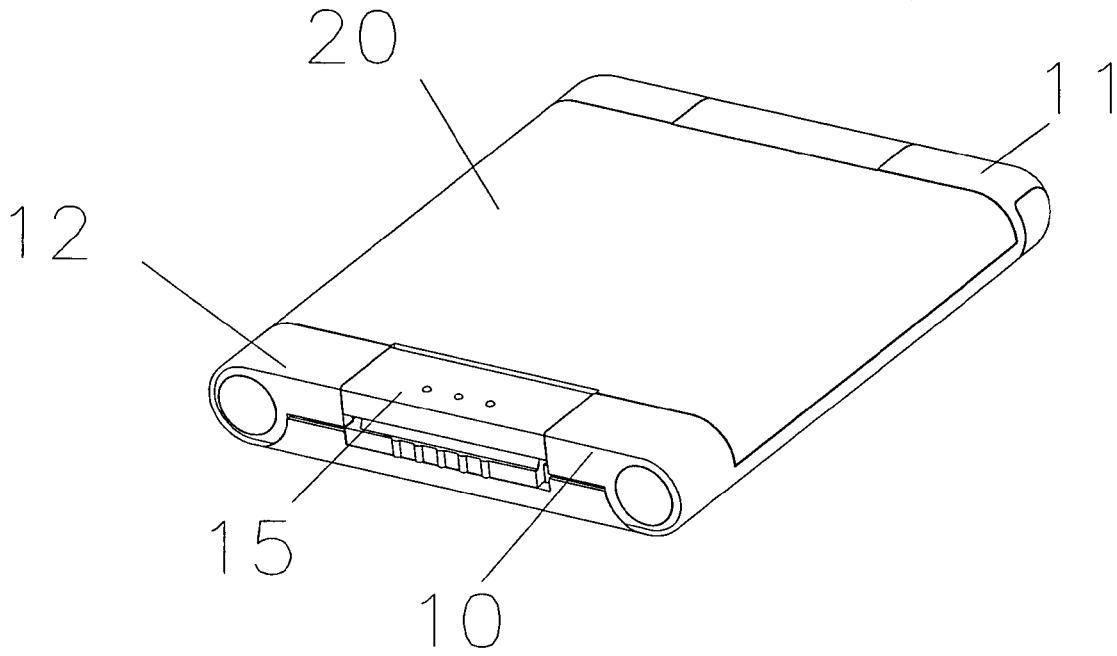
FIG. 11 is a side perspective view of the embodiment shown in FIG. 1 in the folded configuration.

FIGS. 1-11 illustrate a preferred embodiment of the present invention wherein a base 10 supports an actuator button 15. A movable support 20 is pivotally connected to the top 11 of the base 10. The button 15 shown in FIG. 1 is slightly raised for illustrative purposes only. In a closed position, button 15 is preferably flush with the front lower surface 12 of base 10 as shown in FIG. 11. Actuator button 15 is preferably connected to a spring biased latch (not shown) which, upon depression, will release support 20 and panels 30, 40. Support 20 is connected to an operating mechanism which normally biases support 20 into an open position and which comprises a mechanism for dampening the motion of support 20. Therefore, as shown in FIG. 2, after support 20 is released by depression of actuator button 15, support 20 will rotate in the direction of arrow A in a damped pivotal motion. As support 20 pivots towards the open position, right panel 30 will also start to pivot in the direction of arrow B. As right panel 30 pivots toward the open position, left panel 40 will also start to pivot in the direction of arrow C. Both panels 30 and 40 of this preferred embodiment comprise reflective surfaces. While in this preferred illustrated embodiment, the support 20 and panels 30, 40 essentially move simultaneously upon a single depression of actuator button 15, it is also within the scope of the present invention to require multiple depressions of a single button or depressions of different buttons in order to fully open the device into the open configuration.

Figure 3:
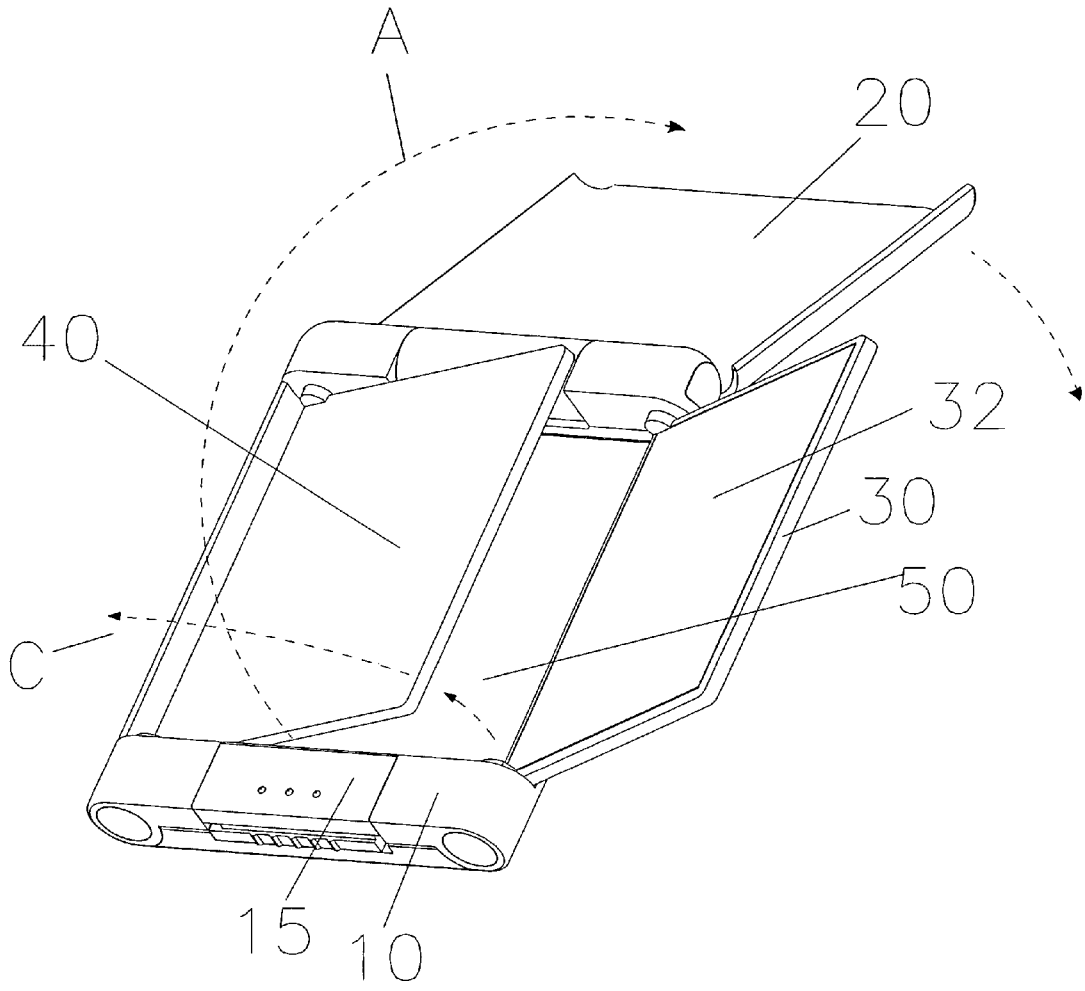
Figure 4:
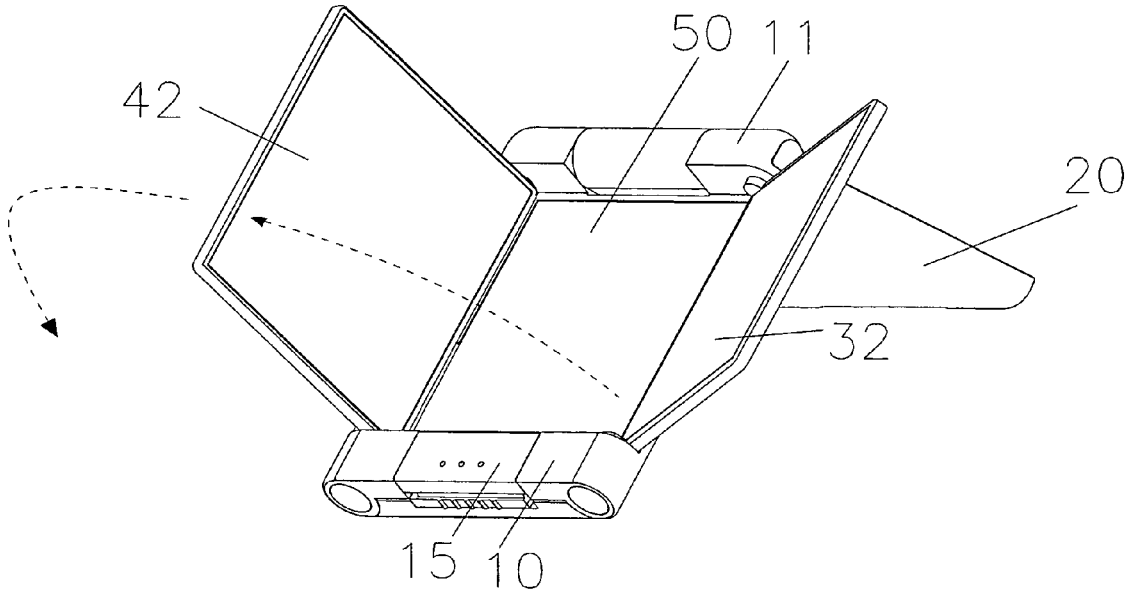

FIGS. 2, 3 and 4 illustrate the direction of movement of the support 20, right panel 30 and left panel 40 to reveal base mirror 50, right mirror 32 and left mirror 42.

Figure 5:
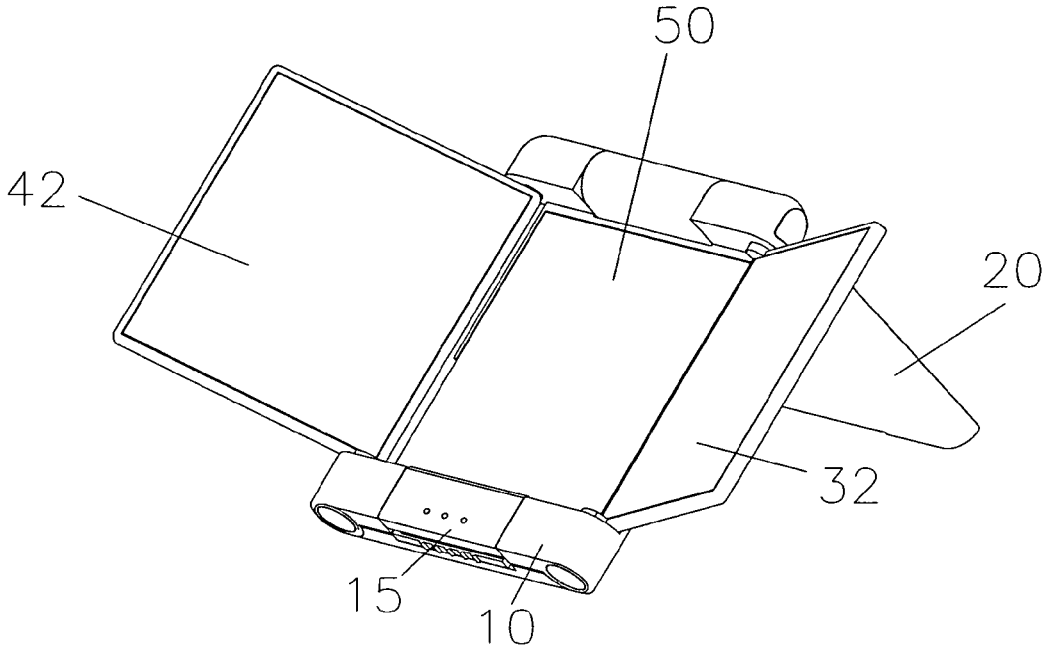
FIG. 5 illustrate the embodiment of FIG. 1 in an open configuration.
Figure 6:
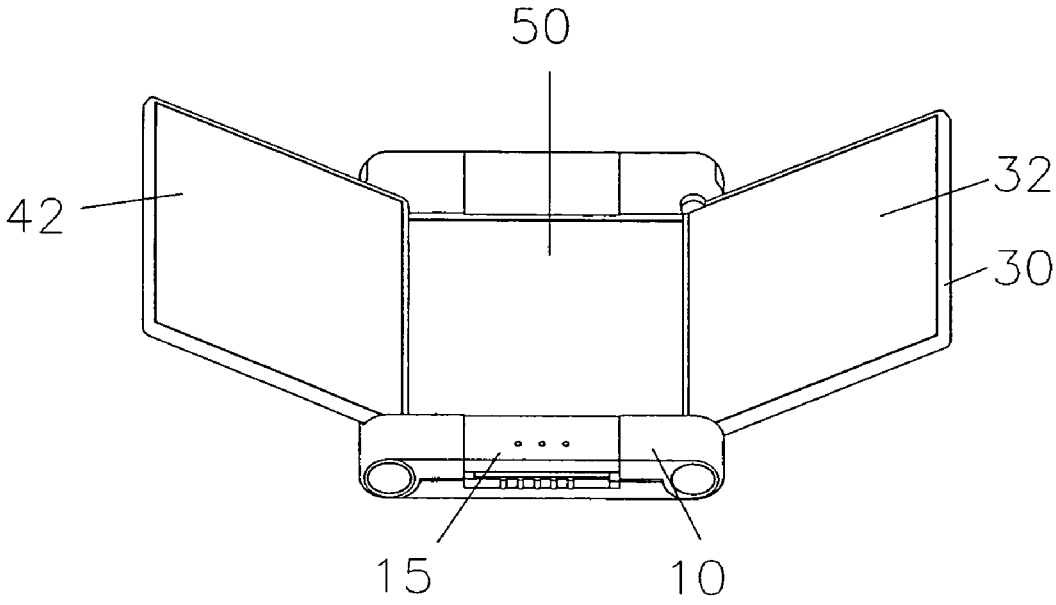
FIG. 6 is a front elevational view of the embodiment shown in FIG. 1 in the open configuration.
Figure 7:
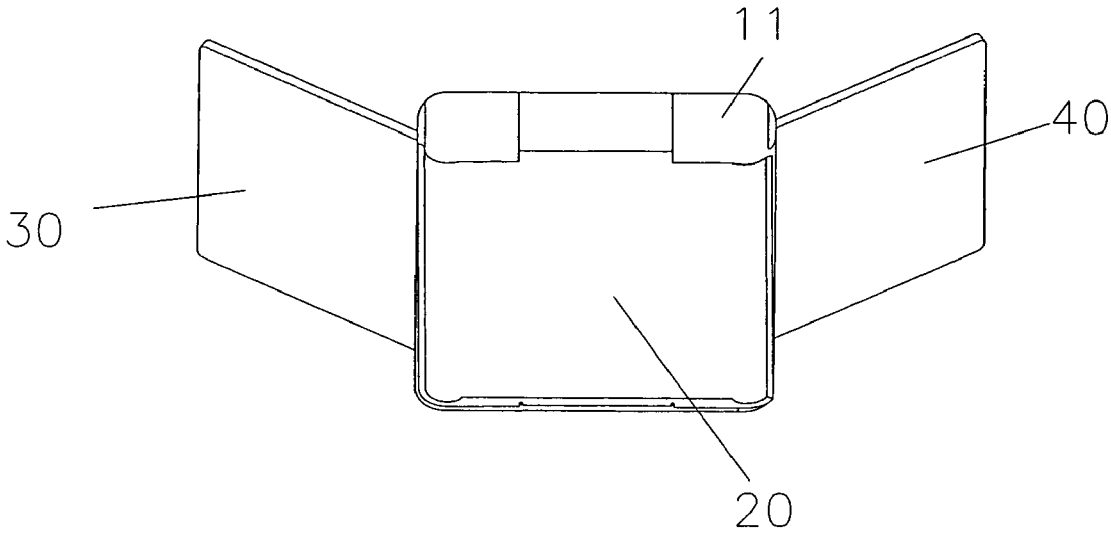
FIG. 7 is a rear elevational view of the embodiment shown in FIG. 1 in the open configuration.
Figure 8:
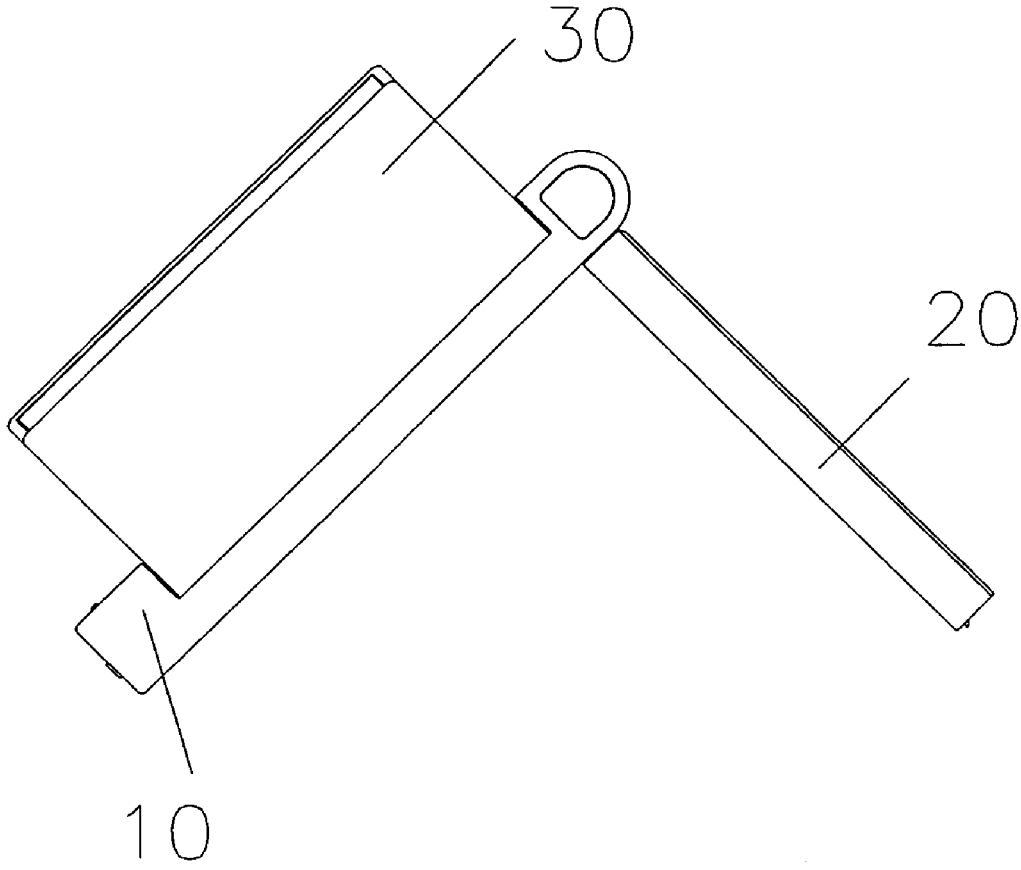
FIG. 8 is a left side view (the right being a mirror image thereof) of the embodiment shown in FIG. 1 in the open configuration.
Figure 9:
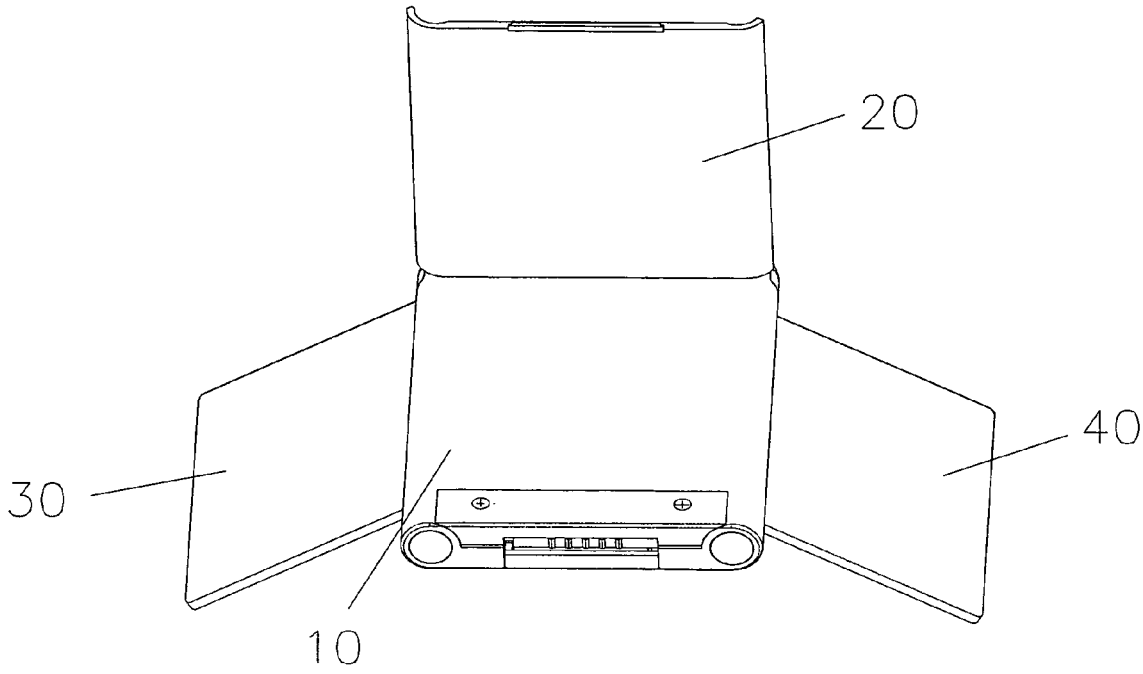
FIG. 9 is a bottom plan view (the underside as it sits on a table) of the embodiment shown in FIG. 1 in the open configuration.
Figure 10:
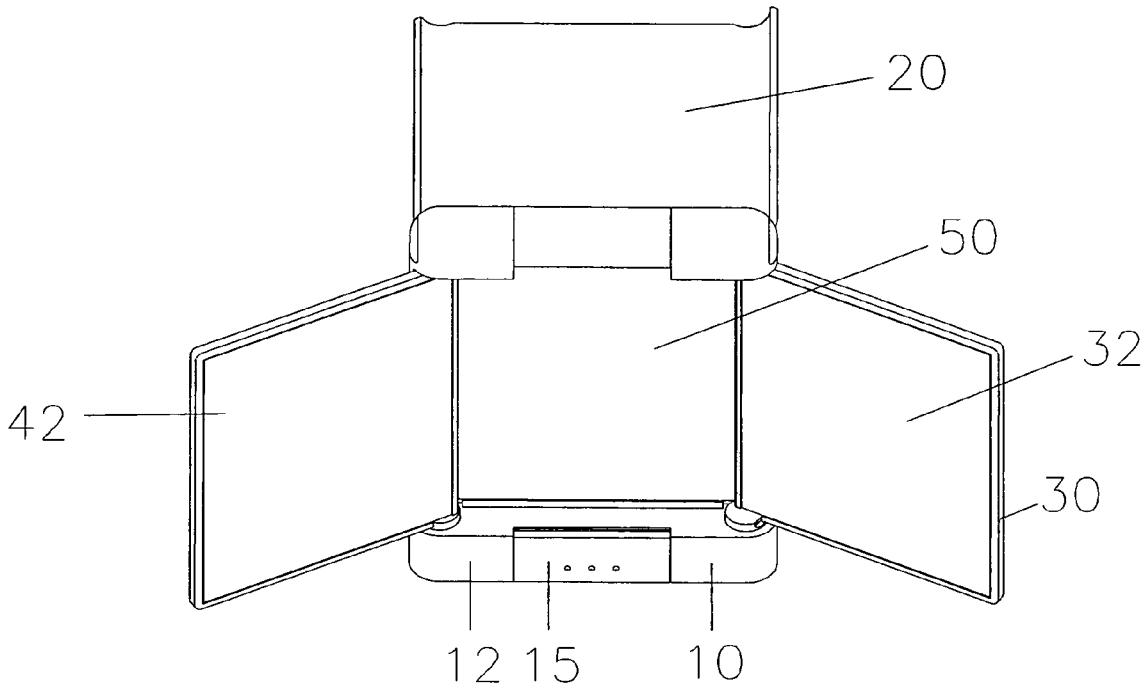
FIG. 10 is a top plan view (looking down from above as it sits on a surface) of the embodiment shown in FIG. 1 in the open configuration.

Each of the support and side panels is preferably connected to an operating mechanism which causes damped, pivotal motion. Therefore, when the support, right panel and left panel are not held down by the latch, support or other panel, respectively, each of these support/panels will rotate in a controlled pivotal motion to the open configuration shown in the figures. The damped support/panel operating mechanism can be of any form known in the art including, for example, the lid operating mechanism disclosed in the present inventor's U.S. Pat. No. 6,178,085. Various types of damped mechanism for moving a structure have previously been disclosed and are known in the art so they will not be described in detail herein. However, from the present description, in this illustrated embodiment, it will be understood that the operating mechanism for the panels will not rotate the panels beyond the plane of the base mirror 50. As support 20 rotates beyond the plane of base mirror 50, the base 10 and mirror 50 are raised into an inclined position as generally illustrated in FIGS. 3, 4 and 5. When the support and side panels are fully extended, the support 20 supports the base 10 in a tilted position on a horizontal surface while the right panel 30 and left panel 40 are preferably disposed at angles to base mirror 50.

Figure 12:
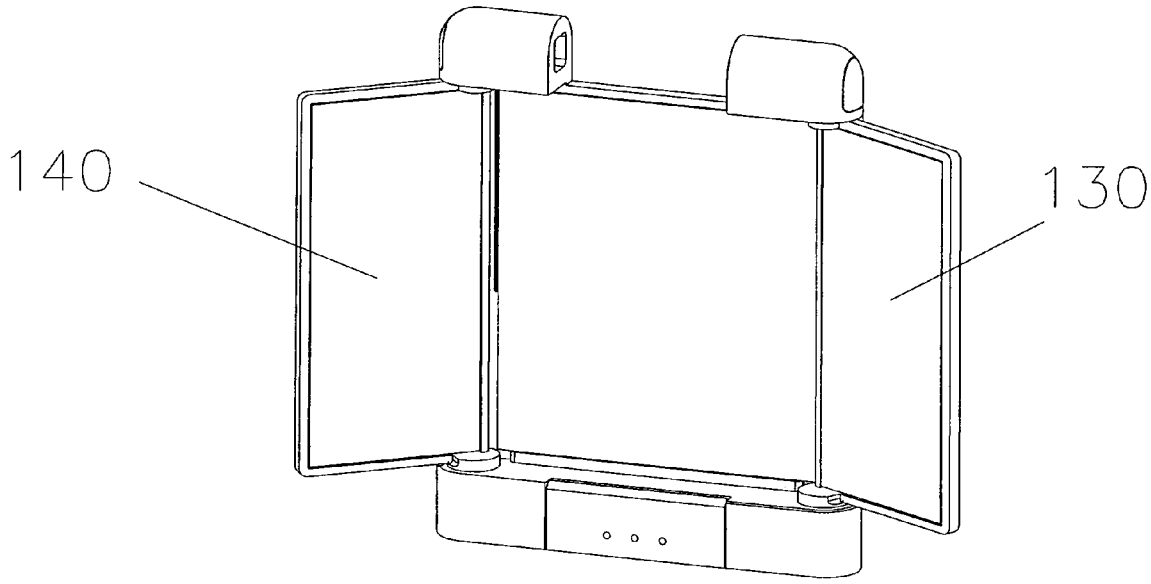
FIG. 12 is a partial, top perspective view of an alternative embodiment of the present invention in the open configuration with the support removed.
Figure 13:
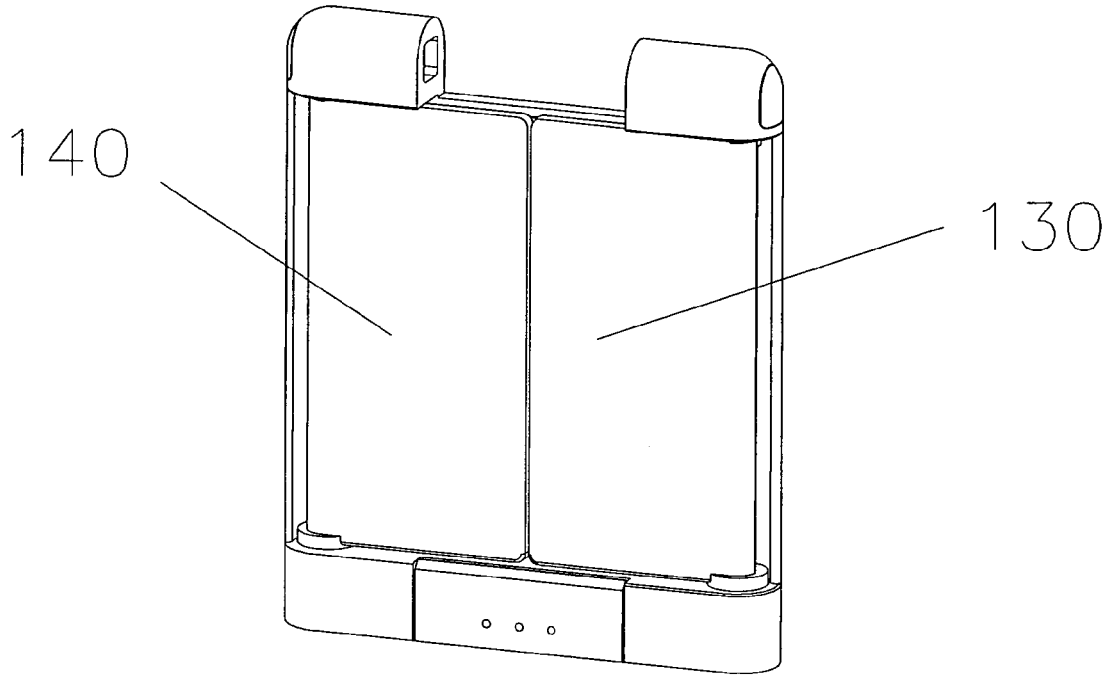
FIG. 13 is a partial, top perspective view of the embodiment shown in FIG. 12 in the closed configuration with the support removed.

FIGS. 12 and 13 illustrate an alternative embodiment of the present invention. According to this embodiment, which is similar to the embodiment shown in FIGS. 1-11 in many respects, the right panel 130 and left panel 140 have a width of approximately half of the width of the panels 30, 40 described above. The panels of this illustrated embodiment do not overlap, but are generally disposed in a coplanar relationship when this device is in the closed configuration as shown in FIG. 13.

Figure 14:
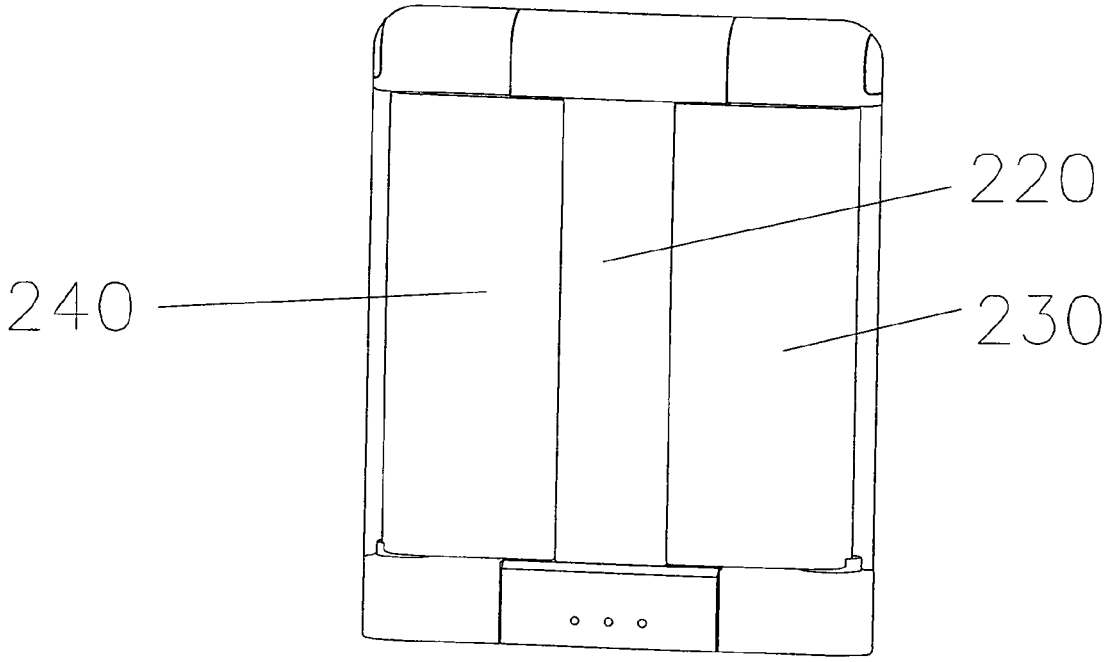
FIG. 14 is a top perspective view of a still further embodiment of the present invention in the closed configuration.

FIG. 14 illustrates another embodiment of the present invention wherein right panel 230, left panel 240 and support 220 lie in a generally coplanar configuration when the device is in a closed position as illustrated.

Figure 15:
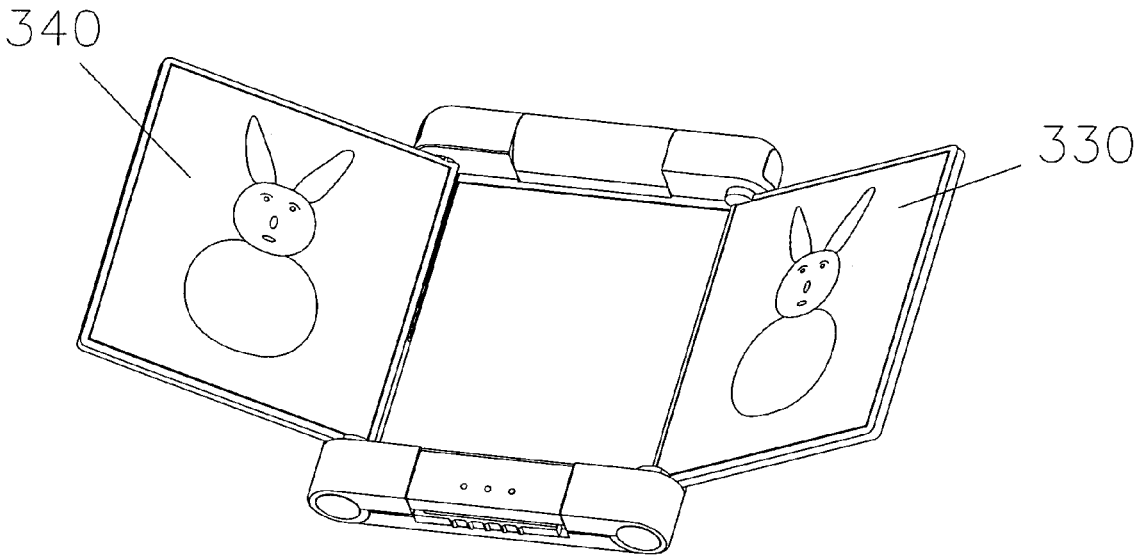
FIG. 15 illustrates an alternative embodiment of the present invention wherein the side panels are picture frames.

FIG. 15 illustrates an alternative embodiment of the present invention wherein, relative to the embodiment shown in FIGS. 1-11, the mirrors on the movable right and left panels, 330 and 340 have been replaced with frames, e.g., picture frames.

Figure 16:
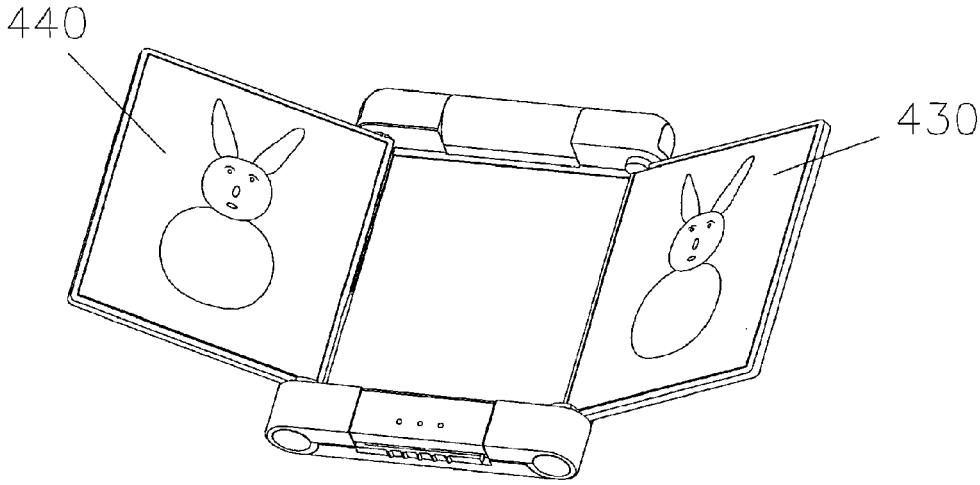
FIG. 16 illustrates an embodiment of the present invention comprising electronic displays.

FIG. 16 illustrates an embodiment of the present invention comprising electronic displays 430 and 440.

While some preferred embodiments of the present invention are small portable devices which can readily be carried in a purse, other portable embodiments are large. Such larger embodiments may be readily put into a bag or a suitcase. Still other embodiments are larger yet, and are best carried in their own dedicated case.

The displays of the present invention can be "fixed" as in a photograph, or may be active, as in the case of an electronic display.

The invention claimed is:

1. A display device comprising:

a base;

a right panel, movably connected to said base, movable from a first position proximate said base to a second position wherein at least a portion of said right panel is further from said base than when said right panel is in said first position;

a left panel, movably connected to said base, movable from a first position proximate said base to a second position wherein at least a portion of said left panel is further from said base than when said left panel is in said first position;

a movable support, movably connected to said base and movable from a first position to a second position, wherein in said second position said base is raised from a support surface further than when said support is in said first position; and means for moving said right panel, said left panel and said support from said respective first positions to said second positions.

2. A display device according to claim 1 wherein at least one of said base, said right panel and said left panel comprise a mirror.

3. A display device according to claim 1 wherein at least two of said base, said right panel and said left panel comprise a mirror.

4. A display device according to claim 1 wherein each of said base, said right panel and said left panel comprise a mirror.

5. A display device according to claim 4 wherein said moving means comprises at least one spring and means for damping the movement of at least one of said base, said right panel and said left panel.

6. A display device according to claim 5 wherein said damping means dampens the movement of each of said base, said right panel and said left panel.

7. A display device according to claim 6 wherein said moving means comprises a plurality of springs and plurality of damping drums.

8. A display device according to claim 1 wherein said moving means comprises at least one spring and means for damping the movement of at least one of said base, said right panel and said left panel.

9. A display device according to claim 8 wherein said damping means dampens the movement of each of said base, said right panel and said left panel.

10. A display device according to claim 9 wherein said moving means comprises a plurality of springs and plurality of damping drums.

11. A display device according to claim 1 wherein said damping device is generally flat when said panels and said support are in said respective first positions.

12. A display device according to claim 11 wherein said base is raised to an angle of greater than about 20° from a horizontal support surface when said base is in said second position.

13. A display device according to claim 12 wherein said right panel and said left panel are rotated greater than about 120° relative to said base when said panels are in said respective second positions.

14. A display device according to claim 11 wherein at least one of said base, said right panel and said left panel comprise a frame.

15. A display device according to claim 11 wherein at least two of said base, said right panel and said left panel comprise a frame.

16. A display device according to claim 11 wherein each of said base, said right panel and said left panel comprise a frame.

17. A display device according to claim 1 wherein said base is raised to an angle of greater than about 20° from a horizontal support surface when said base is in said second position.

18. A display device according to claim 17 wherein said right panel and said left panel are rotated greater than about 120° relative to said base when said panels are in said respective second positions.

19. A display device according to claim 17 wherein said moving means comprises at least one spring and means for damping the movement of at least one of said base, said right panel and said left panel.

20. A display device according to claim 19 wherein said damping means dampens the movement of each of said base, said right panel and said left panel.

21. A display device according to claim 20 wherein said moving means comprises a plurality of springs and a plurality of damping drums.

22. A display device according to claim 17 wherein at least one of said base, said right panel and said left panel comprise a mirror.

23. A display device according to claim 17 wherein each of said base, said right panel and said left panel comprise a mirror.

24. A display device according to claim 17 wherein said base is adapted to rest on a generally horizontal surface when in said first position.

25. A display device according to claim 1 wherein at least one of said base, said right panel and said left panel comprise a frame.

26. A display device according to claim 1 wherein each of said base, said right panel and said left panel comprise a frame.

27. A display device according to claim 1 wherein said right panel and said left panel are not in overlapping relation when in said respective first positions.

28. A display device according to claim 1 wherein said right panel and said left panel are generally coplanar when in said respective first positions.

29. A display device according to claim 1 wherein said support, said right panel and said left panel are not in overlapping relation when in said respective first positions.

30. A display device according to claim 29 wherein said support, said right panel and said left panel are generally coplanar when in said respective first positions.

31. A display device according to claim 1 wherein at least one of said base, said right panel and said left panel comprise an electronic display.

32. A display device according to claim 1 wherein each of said base, said right panel and said left panel comprise an electronic display.

33. A display device according to claim 1 wherein said movable support substantially covers said right panel and said left panel when said movable support is in said first position.

34. A display device according to claim 1 wherein said movable support and said base define a container when said movable support is in said first position.

35. A display device according to claim 1 wherein said movable support rotates about a first axis, one of said right panel or said left panel rotate about a second axis; and wherein said first axis is substantially perpendicular to said second axis.

36. A display device according to claim 1 wherein said movable support rotates about a first axis, said right panel rotates about a second axis;

said left panel rotates about a third axis; and said first axis is substantially perpendicular to said second and third axes.

37. A display device according to claim 1 wherein said movable support, said right panel and said left panel move simultaneously during at least some of the time said support and said panels are moving from said respective first positions to said second positions.

* * * * *